US005232186A

United States Patent [19]

Corkery

[11] Patent Number: 5,232,186

[45] Date of Patent: Aug. 3, 1993

[54] MULTIPLE GARBAGE BAG HOLDER

[76] Inventor: Richard Z. Corkery, 9532-100 Street, Edmonton, Alberta, Canada, T5K0T5

[21] Appl. No.: 887,819

[22] Filed: May 26, 1992

[51] Int. Cl.[5] ..... A63B 55/04

[52] U.S. Cl. ..... 248/97; 211/12; 248/100

[58] Field of Search ..... 248/95, 97, 98, 99, 248/100, 101, 907; 211/12; 220/404; 141/341

[56] References Cited

U.S. PATENT DOCUMENTS 3,893,615 7/1975 Johnson ..... 248/95 X 4,249,663 2/1981 Hewlett ..... 211/12 X 5,050,825 9/1991 Bratset ..... 248/97

5,092,548 3/1992 Bayes et al. ..... 248/95 X 5,101,984 4/1992 Shaw ..... 211/12

*Primary Examiner*—Ramon O. Ramirez

*Attorney, Agent, or Firm*—Anthony R. Lambert

[57] ABSTRACT

A garbage bag holder includes a frame adapted to fit in a garbage container. The frame includes a pair of parallel rods and supports spaced apart on the rods with notches for receiving the handles of several garbage bags which depend into the container. The notches are preferably flared downward so as to retain the handles of garbage bags.

6 Claims, 3 Drawing Sheets

MULTIPLE GARBAGE BAG HOLDER

FIELD OF THE INVENTION

This invention relates to garbage bag holders.

BACKGROUND AND SUMMARY OF THE INVENTION

In some parts of North America re-cycling programs have begun using "blue boxes" for removal of recyclable materials from residential homes. These "blue boxes" are rectangular plastic containers having an open top and are enclosed on the bottom and four sides. The containers may have holes in the bottom for allowing liquids to escape. In their normal operating position, the blue boxes open upward. In this patent document the term "horizontal" means the plane perpendicular to this upward direction. Downward is the opposite direction to upward (that is, towards the bottom of the garbage container).

Typically, users of the recycling service place recyclable materials (glass, cardboard, plastic, metal) into the blue boxes and at intervals, for example once a week, the blue boxes are put out of the home for pick-up. The recyclable materials are often not sorted by the user of the service and therefore the materials are sorted, with consequent expense, by those picking up the recyclable material.

This invention provides a manner in which the recyclable materials may be readily sorted by the user. In one aspect the invention provides a frame adapted for installation in a blue box, and plural means for securing garbage bags on the frame and depending from the frame into the blue box (or other similar plastic garbage container).

Preferably the frame includes parallel rods from which upright members extend, and the upright members include notches for receiving and retaining handles of garbage bags. Other features of the invention will be described in the following. The frame may also be used independently of a rigid garbage container (such as a blue box), and if used on its own can make it unnecessary to use the container at all.

BRIEF DESCRIPTION OF THE DRAWINGS

There will now be described a preferred embodiment of the invention, with reference to the drawings, by way of illustration, in which like numerals denote like elements and in which.

DETAILED DESCRIPTION OF PREFERRED EMBODIMENTS

Figure 1:
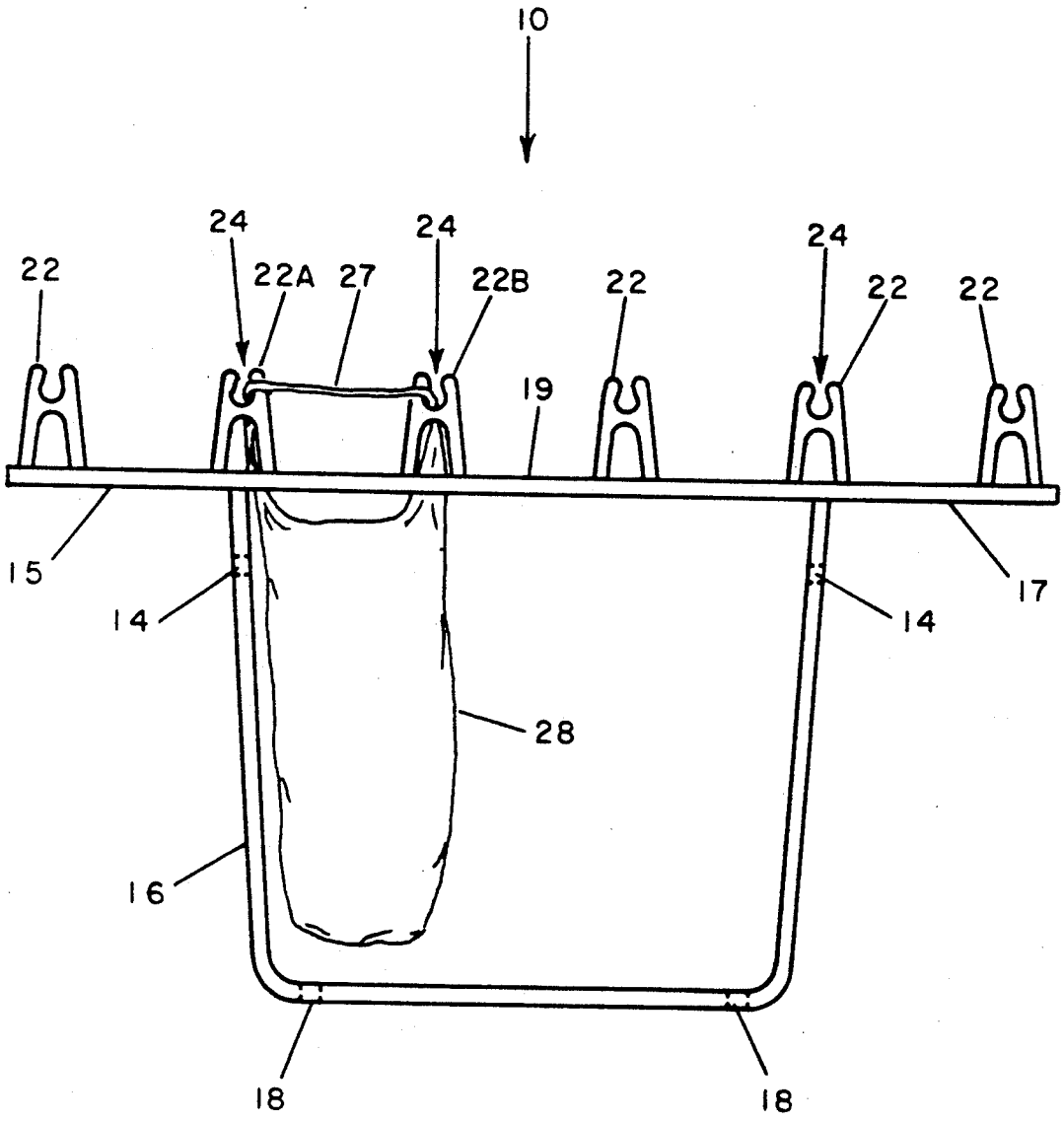
FIG. 1 is a side view of a garbage bag holder according to the invention.
Figure 2:
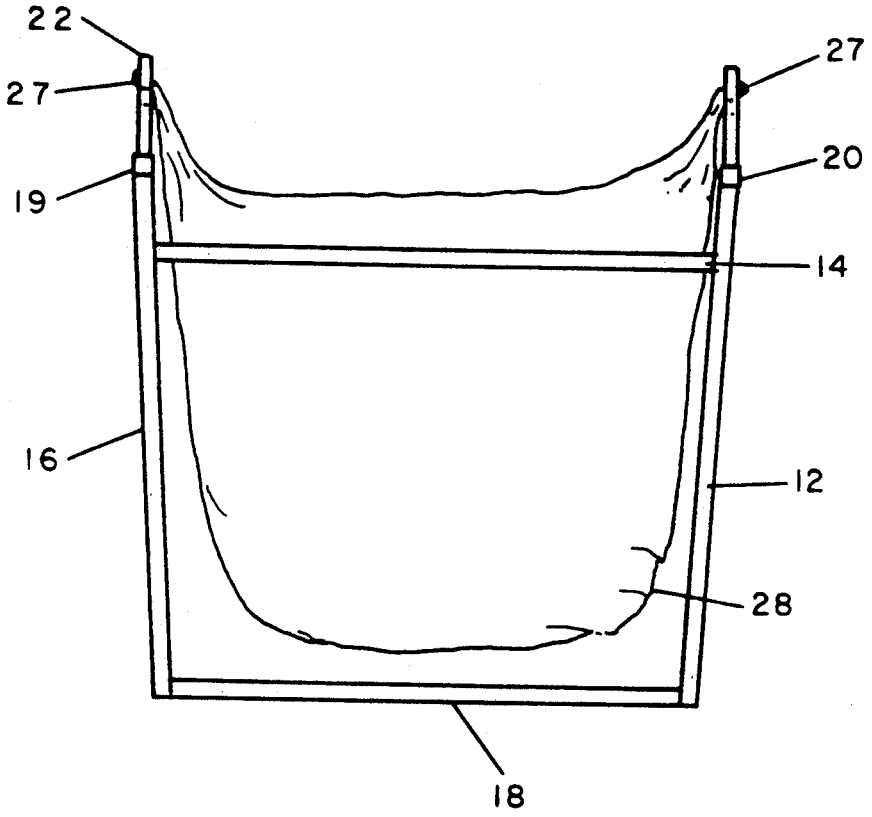
FIG. 2 is an end view of a garbage bag holder according to the invention.
Figure 3:
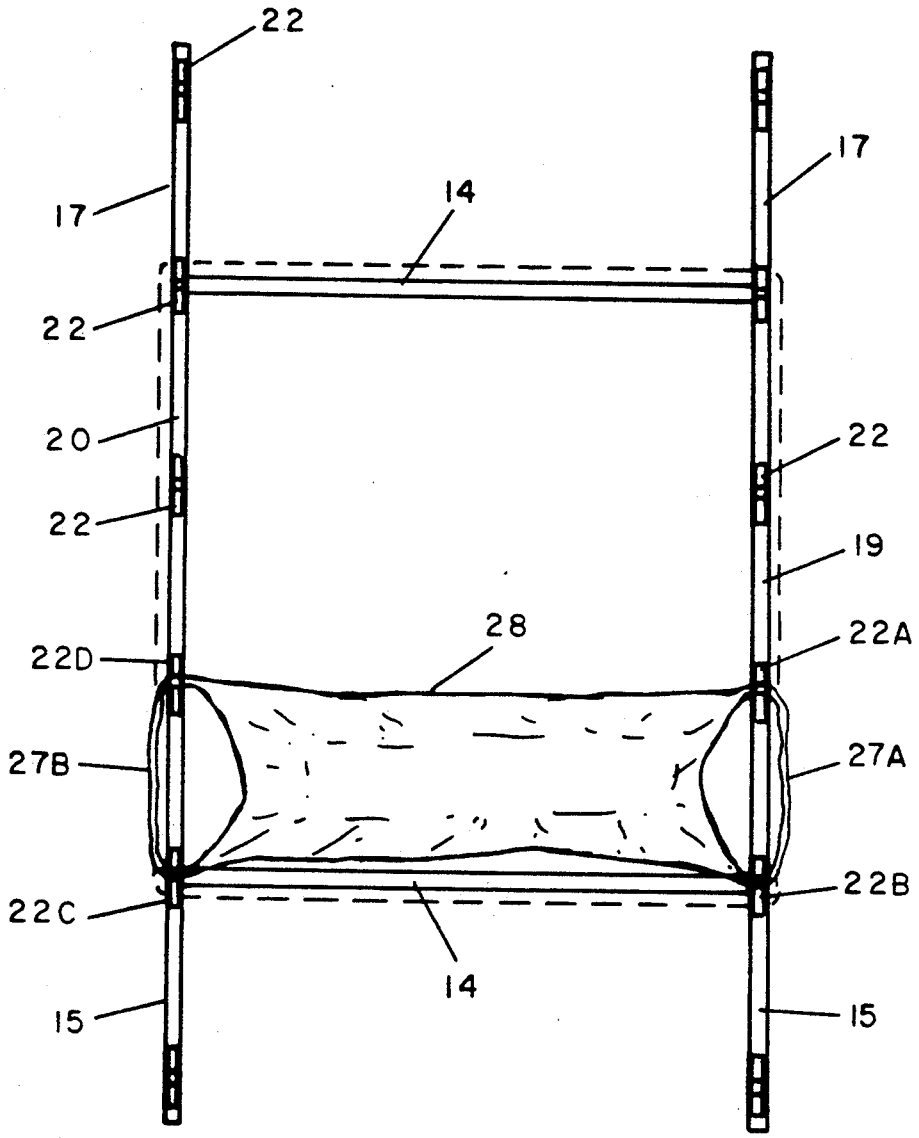
FIG. 3 is a top view of a garbage bag holder according to the invention.

Referring to FIGS. 1, 2 and 3 there is shown a garbage bag holder according to the invention for use for securing garbage bags having a pair of handles. The holder includes a frame generally designated 10 formed from a pair of U-shaped supports 12 and 16. A pair of parallel rods 19 and 20 extend respectively between the upright legs of the U-shaped supports 12 and 16, and extend beyond the upright legs as shown for example at 17, preferably at both ends as shown also at 15. The U-shaped supports are connected by a pair of upper rods 14 and lower rods 18 to complete the frame. The horizontal dimensions of the frame should be slightly less than the horizontal dimensions of the garbage container (the top end of which is shown in ghost outline in FIG. 3) for which the frame is intended so that the frame may fit snugly without pressure within the garbage container.

Extending upwardly from each rod 19 and 20 and spaced apart along the rod is a plurality of upright members 22, which form means for receiving and retaining a garbage bag. The ends 15 and 17 of the rod members each include one upright member (at least) and a portion of another. Each upright member 22 includes a downwardly extending notch 24 which flares outward in the downward direction. Each notch 24 may then receive a handle 27 from a garbage bag with the body of the garbage bag depending into the box. Adjacent upright members 22, for example **22*a* and 22*b*, may receive the same handle 27*a* of a garbage 28 bag and the opposing upright members 22*c* and 22*d* may receive the opposing handle 27*b* of a garbage bag 28 so as to leave the bag in use depending into the garbage container with the garbage bag 28** open to receive recyclable materials. In the model shown, three garbage bags may be held depending into the garbage container and two outer garbage bags, one at each end, may be held depending downward adjacent to but on the outside of the container. Each garbage bag thus opened may receive a different kind (glass, plastic, cardboard, metal, etc) of recyclable material. There will thus be an even number of upright members on each rod, here shown as six for holding five garbage bags. Each notch, except the end notches, can hold the handle for two adjacent garbage bags. The downwardly flared notch assists in preventing the handles of the bags from slipping out of the notches.

In this manner, the user can readily (a) place as many garbage bags depending from the frame into the container as there are kinds of recyclable material and (b) sort the various recyclable materials into the different garbage bags. Those picking up the recyclable materials can easily select and sort the various materials into the appropriate parts of a vehicle used for picking up the recyclable materials, by picking up each individual bag and disposing of its contents in the vehicle.

If desired, the garbage bag holder of the present invention may be used as a stand alone item, supporting more than one garbage bag, and in that case need not be made to conform to the dimensions of a garbage container.

ALTERNATIVE EMBODIMENTS

A person skilled in the art could make immaterial modifications to the invention described and claimed in this patent without departing from the essence of the invention.

I claim:

1. A garbage bag holder for a garbage container having a known horizontal cross-sectional dimension, the horizontal position being defined in relation to the normal operating position of the garbage container, the garbage bag holder comprising:

a frame having horizontal cross-sectional dimensions slightly smaller than the horizontal cross-sectional dimensions of the garbage container, the frame including a pair of spaced apart parallel rod members attached to the frame each of the pair of parallel rod members including a plurality of upright members, each rod member includes a portion extending beyond the frame and each such portion includes at least one upright member; and downwardly extending notches formed within the upright members such that the notches serve as means for retaining a plurality of garbage bags with each garbage bag depending from the frame into the garbage container.

2. The garbage bag holder of claim 1 in which the downwardly extending notches flare outward in the downward direction.

3. The garbage bag holder of claim 1 in which there are an even number of upright members on each rod member.

4. A garbage bay holder comprising:

a frame having a pair of U-shaped supporting members, each U-shaped member including a first and second upright leg, the respective upright legs of the U-shaped members being connected by upper and lower rods, and the upright legs of each U-shaped member having a further rod member extending between them and forming a pair of parallel rod members;

each of the pair of parallel rod members including a plurality of upright members having downwardly extending notches formed within the upright members for retaining a plurality of garbage bags with each garbage bag depending downward from the frame; and.

each rod member including a portion extending beyond the frame and each such portion includes at least one upright member.

5. The garbage bag holder of claim 4 in which the downwardly extending notches flare outward in the downward direction.

6. The garbage bag holder of claim 4 in which there are an even number of upright members on each rod member.

* * * * *